US006021855A

United States Patent [19]

Beccu et al.

[11] Patent Number: 6,021,855

[45] Date of Patent: Feb. 8, 2000

[54] METHOD, DRILLING TOOL AND ROCK DRILL BIT FOR TRANSFERRING IMPACT ENERGY FROM A TOP HAMMER UNIT

[75] Inventors: Rainer Beccu, Houston, Tex.; Per-Olof Liljebrand, Sandviken, Sweden; Urban Olsson, Forsbacka, Sweden; Jan-Erik Sundström, Kungsgården, Sweden

[73] Assignee: Sandvik AB, Sandviken, Sweden

[21] Appl. No.: 09/011,498

[22] PCT Filed: Aug. 22, 1996

[86] PCT No.: PCT/SE96/01039

§ 371 Date: May 6, 1998

§ 102(e) Date: May 6, 1998

[87] PCT Pub. No.: WO97/08421

PCT Pub. Date: Mar. 6, 1997

[30] Foreign Application Priority Data

Aug. 31, 1995 [SE] Sweden ..... 9503013

[51] Int. Cl.[7] ..... E21B 17/07; E21B 10/36

[52] U.S. Cl. ..... 175/321; 175/414; 173/113

[58] Field of Search ..... 175/321, 320, 175/322, 414; 173/113, 114, 200, 122

[56] References Cited

U.S. PATENT DOCUMENTS

| | | | |
|---|---|---|---|
| 3,612,191 | 10/1971 | Martini | 173/73 |
| 3,981,368 | 9/1976 | Lundstrom et al. | 173/104 |
| 4,012,061 | 3/1977 | Olson | 285/133 |
| 4,619,334 | 10/1986 | Gustafsson . | |
| 5,103,903 | 4/1992 | Marks, II | 166/178 |
| 5,305,841 | 4/1994 | Beccu . | |

FOREIGN PATENT DOCUMENTS

| | | |
|---|---|---|
| 37 43 817 A1 | 7/1989 | Germany . |
| 432 280 | 3/1984 | Sweden . |

*Primary Examiner*—Frank S. Tsay
*Attorney, Agent, or Firm*—Burns, Doane, Swecker & Mathis, L.L.P.

[57] ABSTRACT

The present invention relates to a drilling tool for percussive drilling by means of a top hammer unit, which unit gives compressive pulses. The tool comprises at least one drill tube (12) and a drill bit (11), which cooperates via a connection. The drill bit comprises a bit head (13) provided with crushing means (15) and a shank (17). A shoulder (20) is provided in connection with the bit head, said bit portion having a first abutment surface (21) facing towards a free end of the tube. The free end of the tube facing towards the drill bit is povided with a second abutment surface (23), said top hammer unit being provided to tannsfer compressive pulses to the tube. Each compressive pulse is transferred to the drill bit via the impact surfaces (21, 23). The tube and the drill bit comprise cooperating device (19, 24, 25) for driving and retaining. The tool is defined by that it has a relation between the length of the shank and the length of the bit head that is 5 or more. The present invention futher relates to a method, an intermediate portion as well as a drill bit for percussive drilling.

10 Claims, 4 Drawing Sheets

METHOD, DRILLING TOOL AND ROCK DRILL BIT FOR TRANSFERRING IMPACT ENERGY FROM A TOP HAMMER UNIT

BACKGROUND OF THE INVENTION

1. Field of the Invention

The present invention relates to a method for transferring impact energy from a top hammer unit to a bore, which unit gives compressive pulses with a longitudinal direction. The tool comprises an intermediate portion cooperating with a drill bit. The drill bit comprises a shank with a first length as well as a bit head with a second length and provided with crushing means. A bit portion, such as a shoulder or a blind hole, is provided in connection with the bit head, said bit portion having a first abutment surface facing towards the free end of the intermediate portion. The free end of the intermediate portion is provided with a second abutment surface, facing towards the drill bit. The top hammer unit is brought to transfer compressive pulses to the intermediate portion, wherein each compressive pulse is transferred to the drill bit via the impact surfaces. The intermediate portion and the drill bit comprise cooperating devices for driving and retaining. The invention further relates to a drill bit and a drilling tool for drilling with the aid of a top hammer unit, a drill bit as well as an intermediate portion.

2. Description of the Related Art

Through U.S. Pat. No. 4,619,334 is previously known a jointed connection for percussive drilling, said connection comprising an element which connects, relatively each other movable, tube ends. At compressive pulses, the tube ends are brought to abutment against each other while they are separated at tensile pulses. There are several problems with inlaid elements in a drill string for percussive drilling. Elements can easily break during use to the great forces which are used at the drilling. The drill string furthermore becomes complicated and troublesome to mount. A drill bit is shown as a preferred embodiment in said patent, wherein the head of the drill bit has a considerably larger impedance than the impedance of the drill bit shank. This means that the impact between the tube and the bit, a compressive pulse will be reflected upwardly back to the tube, which reflection is proportional to the difference in impedance between the cooperative parts. This reflection of pulses implies a high temperature and a high level of sound, increased wear and impaired efficiency.

OBJECTS OF THE INVENTION

One object of the present invention is to provide a drilling tool at which maximal energy can be transferred to the drilled hole.

Another object of the present invention is to provide a drilling tool at which impacts does not reflect back to the drilling machine.

Still another object of the present invention is to provide a drilling tool at which heat generation in the tool during drilling, is reduced.

Still another object of the present invention is to provide a method for transferring impact energy from a top hammer unit to a drilling tool, relatively freely from losses.

Still another object of the present invention is to provide a rock drill bit, which gives a good efficiency during drilling.

Still another object of the present invention is to provide a drilling tool which generates a low level of sound during drilling.

These and other objects are realized by a drilling tool, a method, an intermediate portion as well as a drill bit such as these are defined in the appended claims with reference to the enclosed drawings. Further advantageous features of the invention are evident from the dependent claims.

DESCRIPTION OF THE DRAWINGS

Below preferred embodiments according to the present invention follows will be described with reference to appended drawings.

DETAILED DESCRIPTION OF THE INVENTION

Figure 1:
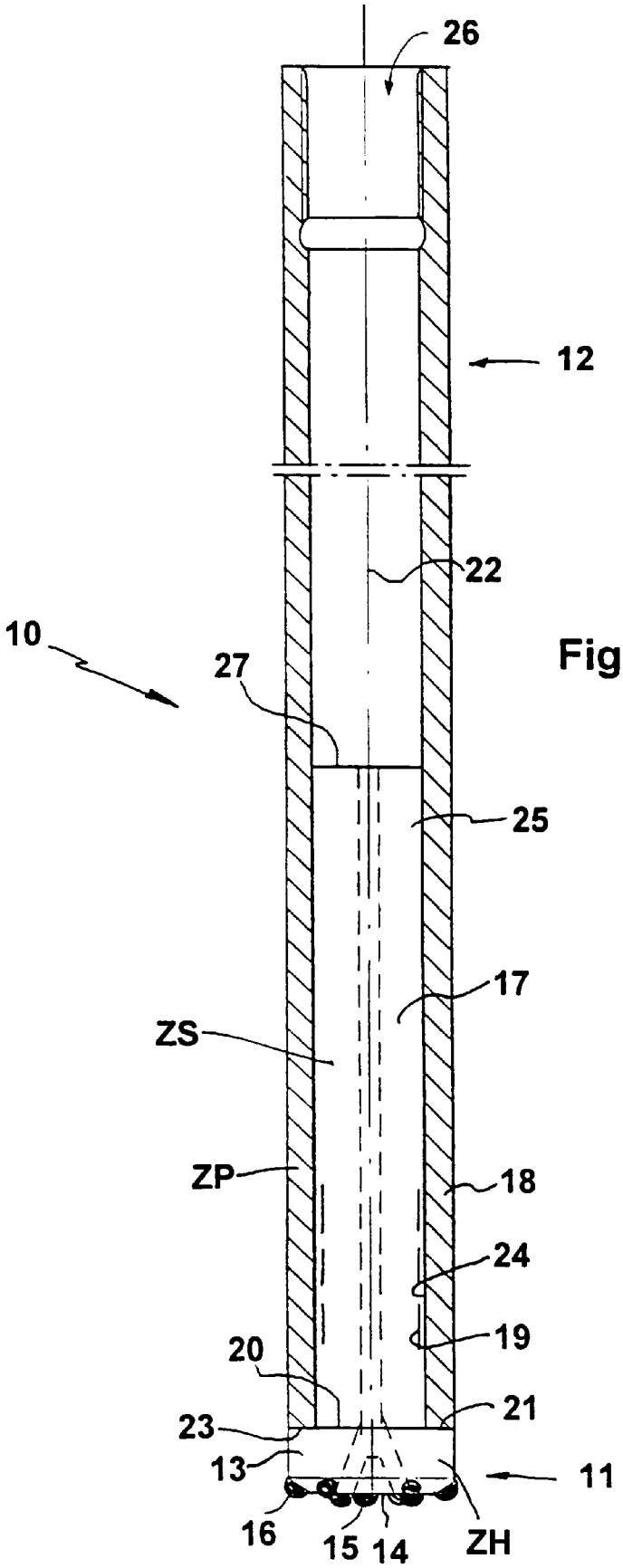
FIG. 1 shows a drilling tool according to the invention, partly sectioned.

The rock drilling tool 10 shown in FIG. 1 comprises a rock drill bit 11 and a drill tube 12. The drill bit 11 has a bit head 13 from which front surface 14 a number of front inserts 15 protrude, as well as peripheral insert 16 arranged in a peripheral wreath, with preferably spherical or ballistic crushing surfaces. The drill bit has a shank 17 provided with external, longitudinal splines or key ways 19 that cooperate with corresponding key ways 24 provided on the tube 12 end 18. The shape of the bottom of each a key way is in most cases adapted to aim at optimum strength for the shank.

The shank 17 constitutes an integral part of the drill bit 11 for percussive drilling. The axially inner end of the bit head 13 consists of a shoulder 20, which has a substantially planar abutment surface 21 facing towards the substantially planar, free end 27 of the shank 17. The end surface 27 never comes into engagement with other parts of the tool, to obtain maximum reflection of pulses. The abutment surface 21 extends substantially perpendicularly relative to a longitudinal center axis 22 of the drilling tool 10.

The free end of the drill tube 12 has the shape of a planar, hollow end surface 23, which extends substantially perpendicularly relative to the central axis 22. The drill tube furthermore comprises key ways, which are manufactured in the drill tube 12 and constitute integrated parts of the drill tube. The shape of each key way bottom is in most cases adapted to aim at optimum strength for the tube.

The rock drilling tool 10 has a central flush channel 26, which surpasses into at least one second channel in the bit head.

From the figure is evident that the abutment surface 21 of the drill bit is intended to abut against the planar end surface 23 of the free end of the tube, i.e. so called shoulder abutment is established, during the transfer of a compressive pulse from the tube to the drill bit via the impact surfaces 21 and 23. The shoulder abutment shall cease when the entire compressive pulse has been transferred to the drill bit, which is more closely described below. A locking means 24 is provided to movably retain the drill bit in the tube. The locking means is provided not to influence axial movements of the drill bit within an axial interval. The locking means may be an eccentrically placed, most preferably hollow, metal pin which cooperates with an axial, elongated recess in the jacket surface of the shank or in one of the key ways, a ring which cooperates with a flange on the shank or similar.

Irrespective the type of locking means, the basic idea is that it must be as light as possible in order to minimize interference of the propagation of the pulse. The transfer of torque can alternatively, instead of cooperating key ways for driving between shank and drill tube, be done by cooperating, in cross-section, polygonally shaped surfaces or by loose keys which cooperate with grooves in both the shank and the drill tube.

When stress wave energy is transmitted through intermediate portions, such as tubes or rods, and drill bits it has been found that the influence by variations in the cross-sectional area A, the Young's modulus E and the density δ can be summarized in a parameter Z named impedance. The impedance is defined by the formula: Young's modulus times the cross-sectional area divided by the propagation speed (speed of sound) in the actual material, that is the impedance $Z=AE/c$, where $c=(E/\delta)^{1/2}$, i.e. the propagation speed of the stress wave. Any combination of A, E and δ that corresponds to a certain value of the impedance Z gives the same result in respect of stress wave energy transmission.

It should be pointed out that the impedance is determined in a certain cross-section transverse to the axial direction of the drill bit 11 and the intermediate portion, i.e. the impedance Z is a function along the axial direction of the drill bit 11 and the intermediate portion. In FIG. 1 is characterized impedance with ZP for the tube 12, with ZH for the head 13 and with ZS for the shank 17.

Therefore, within the scope of the present invention it is of course possible that the impedances ZP, ZH and ZS for the different portions 12, 13 and 17, respectively may vary slightly, i.e. the impedance does not need to have a constant value within each portion but can vary in the axial direction of the portions 12, 13 and 17. In practice the design of the drill bit 11 implies that, as mentioned above, the provision of for example round circumferential grooves and/or splines can exist. Also the provision of for example a round circumferential collar may be necessary.

Figure 2:
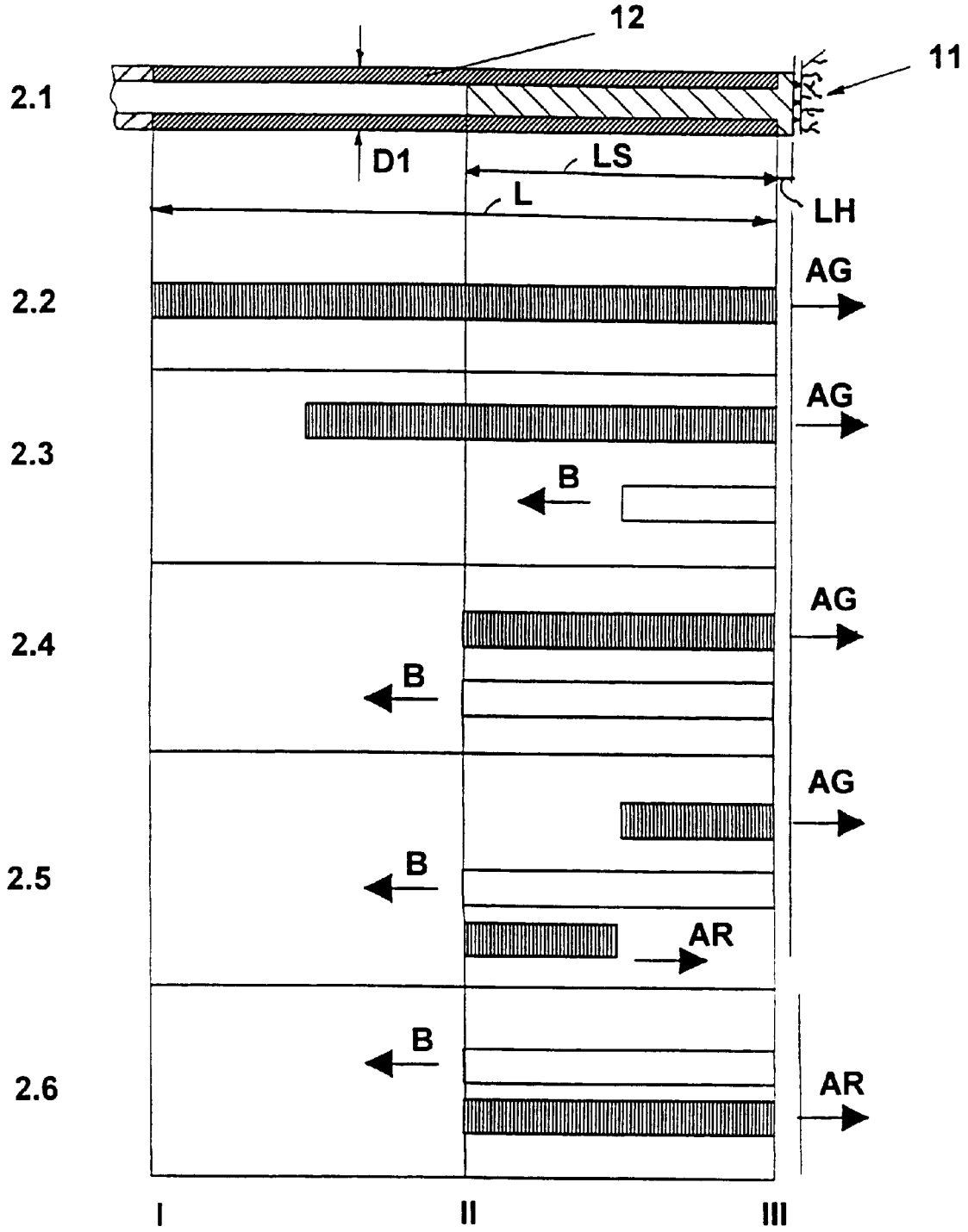
FIGS. 2.1 to 2.6 schematically show, a compressive pulse transformation in a drilling tool according to the present invention.

In FIG. 2 a drilling tool according to the present invention is schematically shown, in a number of partial sections, wherein the propagation of a generated and reflected compressive pulse AG and AR (shaded), respectively, and of a tensile pulse wave B in the drill tube 12 and the drill bit 11 appear graphically. The course of one hammer blow happens during about 1 millisecond. Line I signifies the finish of the compressive pulse wave AG when the compressive pulse wave reaches the end surface 23; the line II signifies the position of the reflection surface 27,; line III signifies the position of the impact interface. The drill bit is preferably in contact with the rock material which is drilled via spherical or still preferably pointed inserts. Spherical inserts substantially does not reflect any compressive pulse back into the drill bit 12 with a tool according to the present invention but the advantage with pointed inserts is that the reflection becomes still somewhat less.

In FIG. 2.1 a drilling tool according to the present invention is schematically shown. The axial length of the shank 17 from the shoulder 20 to the free end of the shank is LS and the height of the drill bit 11 between the shoulder 20 and the front surface 14 is LH. The length LS of the shank 17 is approximately the half of the length L of the compressive pulse. With D1 is characterized the outer diameter of the drill tube and of the shoulder 20. The relation LS/LH is as big as possible and definitive bigger than 5 and of practical reason it is within the interval of 7–70, most preferably 9–20. In theoretical extreme cases with the length of the shank 2 m and the height of the bit 0.03 m, the relation becomes 67.

FIG. 2.2 shows the incoming compressive pulse AG in the most left or most right cross-section of the drill tube 12, according to FIG. 2.1, such as a pulse appears when a relatively long and narrow impact piston is utilized in the top hammer unit. The illustration of the compressive pulse is idealized for the sake of clarity. In reality the compressive pulse has for example, successively tapering ends. The start and finish of the compressive pulse is defined hereinafter such as the value of the pulse when it corresponds to the half maximal amplitude of the pulse. The forward or starting end of the compressive pulse AG in this situation has just reached the end surface 23 of the drill tube at line III, while its rearward or finishing end reached line I. The drill bit has still not been moved.

In FIG. 2.3 a part, about a quarter, of the compressive pulse has reached the drill bit 11 and transferred in to a tensile pulse B due to the inertia in the great mass of the shank. The tensile pulse wave B has in an ideal condition the same amplitude as the compressive pulse wave. The tensile pulse B is on its way towards the reflection surface 27 of the drill bit, which is situated at a distance from the impact place, which is substantially the same as half the length of the compressive pulse AG. The inertia of the drill bit makes that it will not be moved until the entire impact wave comes into the drill bit.

In FIG. 2.4 half of the compressive pulse AG has passed the impact place and has been changed to the tensile pulse B, which now has reached the reflection surface in the free end of the shank.

Since the tensile pulse B does not meet any impedance at the free end surface 27 according to FIG. 2.5, the tensile pulse is remodeled to a reflected compressive pulse AR.

In FIG. 2.6 the entire compressive pulse AG from the drill tube 12 has been transferred to the drill bit. In this moment the compressive pulse AR begins to push the drill bit 11 axially forwardly due to that the compressive pulse AR reaches the front of the drill bit. Thereby also a separation of the drill bit from the drill tube occurs at the impact place. A part of the compressive pulse AR in the drill bit thereby will be transmitted to the rock and a play arises between the drill bit and the rock, whereby the compressive pulse is remodeled to a tensile pulse in the front surface. But since a gap is developed between the drill tube and the drill bit, the tensile pulse is maintained within the drill bit. This implies that the energy which remains in the drill bit is used and is transferred to the rock after further reflections.

Figure 3:
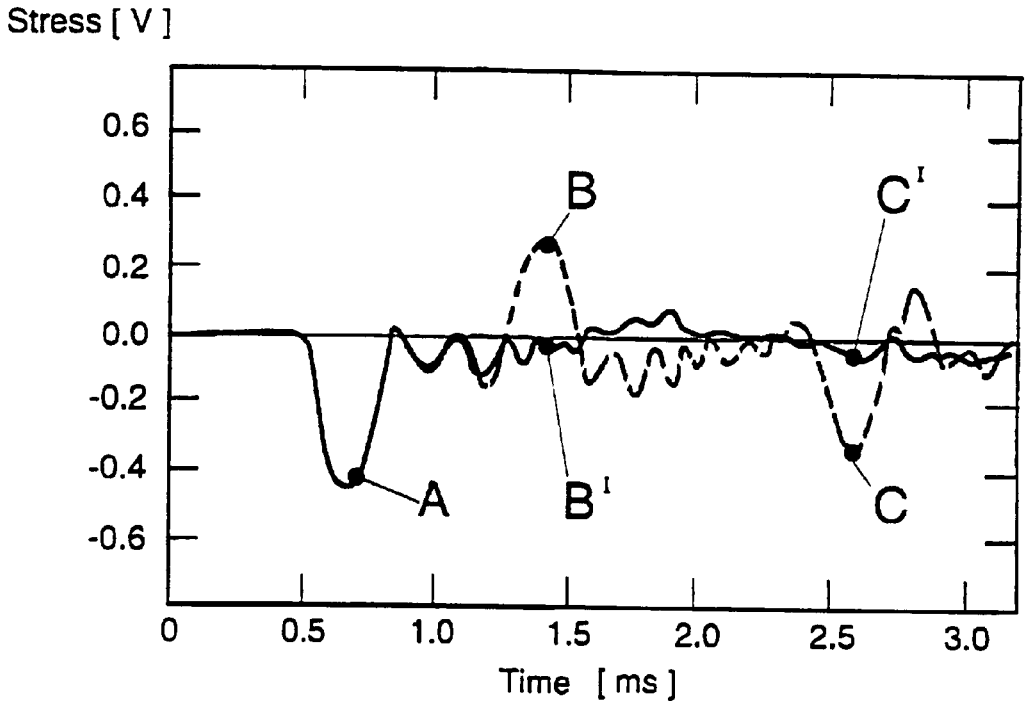
FIG. 3 shows the real propagation of a compressive pulse in a drilling tool according to the present invention and in a conventional drilling tool.

A graph is shown in FIG. 3 of a representative hammer blow, wherein the amplitude of the pulse is shown as a function of the time. The purpose with test is to see how much reflected pulses come back in the tube. In FIG. 3 the fat curve shows the propagation of pulses in a tool according to the present invention and the dashed curve in the graph relates to a conventional tool with a drill bit in threaded connection with a drill tube. The two different tools have however/yet the same length and diameter.

A strain gage is attached to the axial midpoint of the drill tube during the entire course of events such that compressive and tensile pulses can be detected. The gage registers to begin with, a compressive pulse A for both tools in connection with the hammer blow propagating in direction towards the respective drill bit. The tube of the conventional tool obtains a reflected tensile pulse, at B, from the rock, while the tool according to the present invention at B' has substantially reverted to zero level regarding pulses. Furthermore an additional compressive pulse comes in the tube of the conventional tool at C, reflected from the shank of the top hammer unit, while the tool according to the present invention at C' remains substantially at the zero level. At measurement during continuous drilling with the tool according to the present invention no reflecting pulses were obtained in the drill tube. The reflected pulses in the tube of the conventional tool create increased wear, increased temperature and level of sound as well as impaired efficiency in relation to the tool according to the present invention. Temperature measurements have been made during drilling, wherein the temperature of the tube end of the tool according to the present invention was a quarter of the temperature of the tube end of the conventional the tool.

Figure 4:
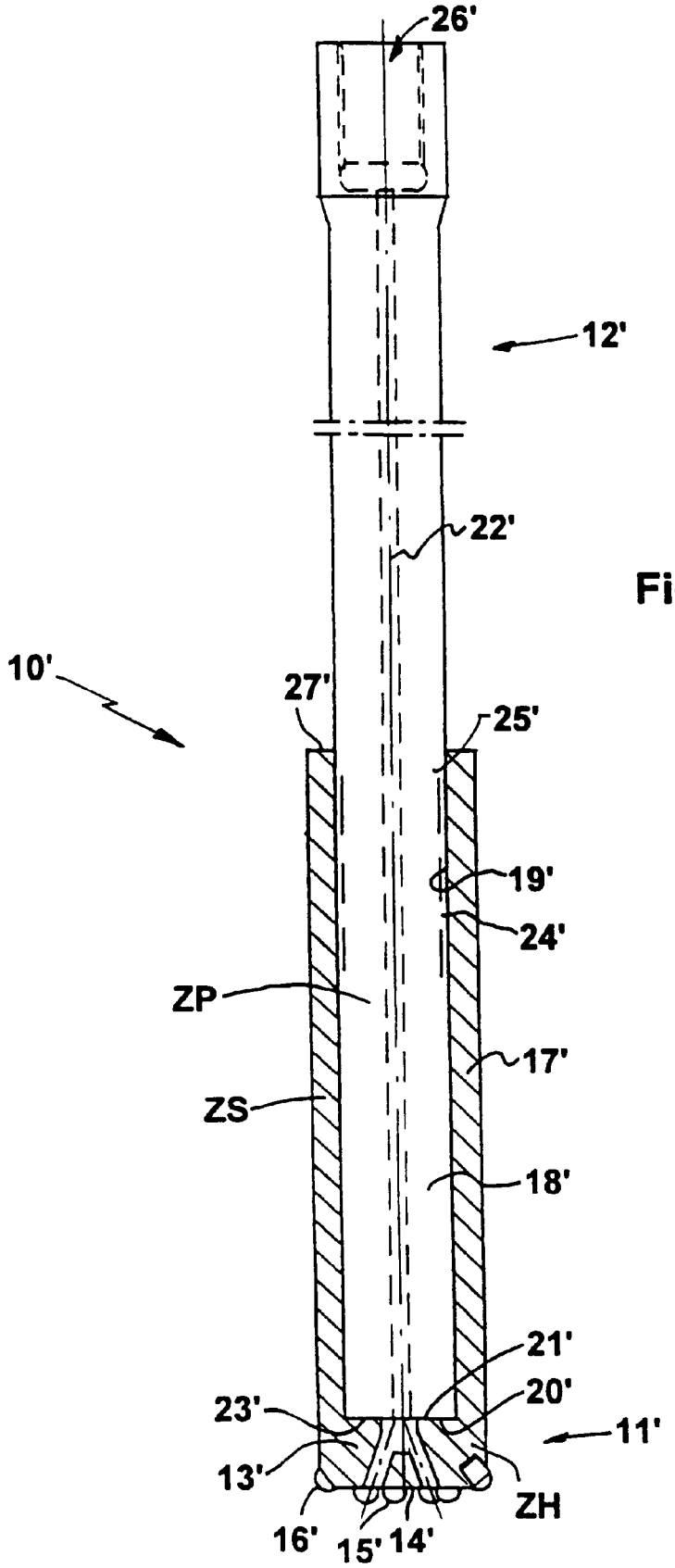
FIG. 4 shows an alternative embodiment of a drilling tool according to the present invention, partly sectioned.

In FIG. 4 a partly sectioned view is shown of an alternative embodiment of a drilling tool 10' according to the present invention. The rock drilling tool 10' comprises a drill rod 12' inserted in a rock drill bit 11'. The drill bit 11' has a bit head 13' from the front surface 14' of which protrude a number of front inserts 15' as well as peripheral insert 16' provided in a peripheral wreath. The drill bit has a shank 17' provided with internal, longitudinal splines or key ways 19' that cooperate with corresponding external, key ways 24' provided on the end 18' of the rod 12'.

The shank 17' constitutes a integral part of the drill bit 11' adapted for percussive drilling. The axially inner end of the bit head 13' consists of a blind hole 20', which includes a substantially planar abutment surface 21' facing towards the free end 27' of the shank 17'. The end surface 27' does not contact other parts of the tool, in order to obtain maximum reflection of pulses. The abutment surface 21' extends substantially perpendicularly relative to the longitudinal central axis 22' of the drilling tool 10'.

The free end of the drill rod 12' has the shape of a planar end surface 23', which extend/substantially perpendicularly relative to the central axis 22'. The drill rod furthermore comprises key ways, which are made externally on the drill rod 12' and constitute integrated parts of the drill rod.

The rock drilling tool 10' has a central flush channel 26', which surpasses in at least one second channel in the bit head.

It is evident from the figure that the abutment surface 21' of the drill bit is intended to abut against the planar end surface 23' on the free end of the rod, i.e. so called shoulder abutment is established, while a compressive pulse is transferred from the tube to the drill bit via the impact surfaces 21' and 23'. A locking means 24 is provided that movably retains the rod in the drill bit. The locking means is provided not to influence axial movements of the drill bit within an interval. The locking means may be an eccentrically placed, preferably hollow, metal pin which cooperates with an axial, elongated recess in the jacket surface of the rod, a ring which cooperates with a flange on the rod or similar. The transfer of torque can alternatively, instead of cooperating key ways for driving between shank and drill tube, be done by cooperating, in cross-section, polygonally shaped surfaces or by loose keys which cooperate with grooves in both the shank and the drill rod.

The course of pulses in the drilling tool 10' and the dimensions of the drill bit 11' are similar to which is described in connection with FIGS. 1–3. A difference however is that the compressive pulse is transferred radially outwardly in this case rather than from the outside and inwards.

According to an appended claim an intermediate portion is provided in order to join a drill bit to a top hammer unit, wherein the portion 12;12' is substantially tube or rod shaped. The end of the intermediate portion facing towards the drill string comprises a thread. The second end of the intermediate portion 12;12' facing towards the drill bit comprises torsion transferring, axially extending driving surfaces 24;24', which allow axial relative motion of the drill bit. The second end surface 18:18' comprises an end surface 23;23' for transfer of compressive pulses.

The invention is in no manner limited to the above described embodiments but may freely be varied within the limits of the appended claims.

We claim:

1. A method for transferring impact energy from a top hammer unit, which unit gives compressive pulses having a length, the method comprising the steps of:

providing a tool comprising an intermediate portion and a drill bit, said drill bit comprising a shank having a first length and a bit head having a second length, said bit head being provided with crushing means and a bit portion, said bit portion having a first abutment surface facing towards a free end of said intermediate portion, said free end of said intermediate portion being provided with a second abutment surface;

transferring compressive pulses from the top hammer unit to the intermediate portion, wherein each compressive pulse is transferred to the drill bit via the first and second abutment surfaces; and converting a major part of the compressive pulse which propagates in the intermediate portion to a tensile pulse in the shank by having a ratio between the first length of the shank and the second length of the bit head of 5 or more, while rotating and percussing against a rock material for making a hole therein.

2. The method according to claim 1, wherein the compressive pulse is transferred to the drill bit via the first and second surfaces and that the first length of the shank is chosen substantially to half of a length of the compressive pulse, such that the tensile pulse arisen in the drill bit is converted at an end of the shank to a reflected compressive pulse, which reflected compressive pulse then propagates in direction towards the drill bit.

3. The method according to claim 1, wherein an impedance of the drill bit and an impedance of the intermediate portion are chosen such that the first abutment surface of the bit portion does not disengage the second abutment surface of the intermediate portion until the entire compressive pulse has been transferred to the drill bit.

4. The method according to claim 3, wherein the compressive pulse is transferred radially inwardly or radially outwardly to the shank and that the shank is provided with an impedance which is substantially similar to the impedance of the intermediate portion.

5. A drilling tool for percussive drilling by means of a top hammer unit, which unit gives compressive pulses with a length, said tool comprising at least one intermediate portion, such as a drill tube or a drill rod, and a drill bit, said drill bit being disposed within said intermediate portion and comprising a shank having a first length and a bit head having a second length, said bit head being provided with crushing means and a bit portion, said bit portion having a first abutment surface facing towards a free end of the intermediate portion having a second abutment surface, said top hammer unit being provided to transfer compressive pulses to the intermediate portion, wherein each said compressive pulse is transferred to the drill bit via the first and second abutment surfaces, wherein a ratio between the first length of the shank and the second length of the bit head is 5 or more.

6. The drilling tool according to claim 5, wherein the compressive pulse is provided to be transferred to the drill bit via the first and second abutment surfaces and that the first length of the shank is substantially half of the length of the compressive pulse, such that a tensile pulse arisen in the drill bit is converted in an end of the shank to a reflected compressive pulse.

7. The drilling tool according to claim 6, wherein an impedance of the drill bit and an impedance of the intermediate portion are such that the first abutment surface of the bit portion does not disengage the second abutment surface of the intermediate portion until an entire compressive pulse has been transferred to the drill bit and that the compressive pulse is provided to be transferred radially inwardly to or radially outwardly to the shank.

8. A rock drill bit for percussive drilling by means of a top hammer unit, said drill bit comprising a shank having a first length and a bit head having a second length, said bit head being provided with crushing means and a bit portion, said bit portion having a first abutment surface facing towards a drill tube or a free end of a drill rod, wherein a ratio between the first length of the shank and the second length of the bit head is 5 or more.

9. The rock drill bit according to claim 8, wherein the ratio lies within the interval of 7–70, preferably 9–20.

10. An intermediate portion in a drill string for joining a drill bit to a top hammer unit, said intermediate portion being substantially tube or rod shaped, wherein a first end of the intermediate portion facing towards the top hammer unit comprises a thread and a second end of the intermediate portion facing towards the drill bit, comprises torsion transferring, axially directed driving surfaces, and that the second end comprises an end surface for transferring compressive pulses.

* * * * *